United States Patent [19]

Whitfield

[11] Patent Number: 4,631,011

[45] Date of Patent: Dec. 23, 1986

[54] FLUID HANDLING DEVICE USEFUL AS A PUMP, COMPRESSOR OR ROTARY ENGINE

[76] Inventor: Roger R. Whitfield, 501 Robin Dr., Lynchburg, Va. 24502

[21] Appl. No.: 811,414

[22] Filed: Dec. 20, 1985

Related U.S. Application Data

[63] Continuation-in-part of Ser. No. 709,381, Mar. 7, 1985, abandoned.

[51] Int. Cl.[4] ..... F01C 3/06; F03C 2/00; F04C 3/00

[52] U.S. Cl. ..... 418/68; 418/161; 418/165

[58] Field of Search ..... 418/68, 160, 161, 164, 418/165, 195

[56] References Cited

U.S. PATENT DOCUMENTS

| | | | |
|---|---|---|---|
| 324,246 | 8/1885 | Fielding | 418/68 |
| 826,985 | 7/1906 | Appel . | |
| 1,150,430 | 8/1915 | Hamann | 418/68 |
| 1,226,864 | 5/1917 | Cyphers et al. | 418/68 |
| 2,204,760 | 6/1940 | Jensen | 418/68 |
| 3,877,850 | 4/1975 | Berry | 418/68 |

FOREIGN PATENT DOCUMENTS

| | | | |
|---|---|---|---|
| 592586 | 5/1959 | Italy | 418/68 |
| 821747 | 4/1981 | U.S.S.R. | 418/68 |

*Primary Examiner*—John J. Vrablik
*Attorney, Agent, or Firm*—Richard P. Matthews

[57] ABSTRACT

A fluid handling device which when suitably configured can be used as a pump, compressor or as a rotary engine. In the illustrated application, there are three primary active components. These are two identical rotating segments or pistons and a centrally disposed rotating disk that forms chambers of variable volume with the rotating segments or pistons. The disk member carries a spherical chamber open at diametrically opposed locations to receive a pair of rotating shafts which carry the rotating segments or pistons. This spherical chamber forms a seal with complementary spherical surfaces on the rotary piston members. The disk member is journalled in two sets of bearings carried by yoke members one of which is carried by each rotating shaft.

3 Claims, 23 Drawing Figures

FLUID HANDLING DEVICE USEFUL AS A PUMP, COMPRESSOR OR ROTARY ENGINE

This application is a continuation-in-part of Ser. No. 709,381, filed Mar. 7, 1985, abandoned as of the filing date of this application.

This invention relates to a fluid handling device and, more particularly, to a fluid handling device which when suitably configured can be used as a pump, compressor or as a rotary engine.

BACKGROUND OF THE INVENTION

The general functioning of the apparatus of the present invention is similar to that shown in U.S. Pat. No. 3,877,850 Berry and U.S. Pat. No. 2,204,760 Jensen. Because of this general similarity of functions, these two patents are hereby incorporated by reference. There are two problem areas for these two patents which are improved upon in the present invention. The first is that the bearings for the rotating piston members are located within the active chamber. This causes an undesirable contamination within the active chamber from wear of the parts. Additionally, more difficult thermodynamic problems are created because of the heat generated by the frictional contact within the active chamber. The second difficulty for these two patents is a common problem of the industry, namely, that of obtaining proper seals in rotary internal combustion engines.

SUMMARY OF THE INVENTION

In accordance with the present invention, the foregoing difficulties and shortcomings of the known prior art are effectively overcome. In particular, the bearings for the active elements of the invention are located outside the active chamber thereby allowing better control of contamination and thermodynamic considerations. Secondly, the chamber seals are greatly improved in that the rotating elements do not carry any of the dynamic loads which are shunted to the bearings and the internal variable volume chambers ar expanded and contracted by the relative reciprocating action between the rotating pistons and an oscillating central disk member.

The rotating pistons have at least a pair of angularly disposed flat surfaces and either a curvilinear or spherical shell portion. The centrally located disk member in its oscillatory movement forms a plurality of variable volume chambers with the flat surfaces of the rotating pistons. Additionally, the centrally disposed disk member carries a complementary shaped surface, either curvilinear or spherical, to form a seal with the shell portions of each of the rotating pistons. This centrally disposed disk member is journalled in bearings provided at the extremities of a pair of yoke members externally of the shell member. The yoke members are displaced 90° with respect to each other and the journalled portions of the centrally disposed disk member are in a common plane which passes through the centrally disposed disk member. Each rotary shaft carries one of the yoke members and the shafts themselves are disposed at an angle other than 180° to one another.

The inherent advantages and improvements of the present invention will become more readily apparent by reference to the following detailed description of the invention and by reference to the accompanying drawings wherein.

Figure 21:
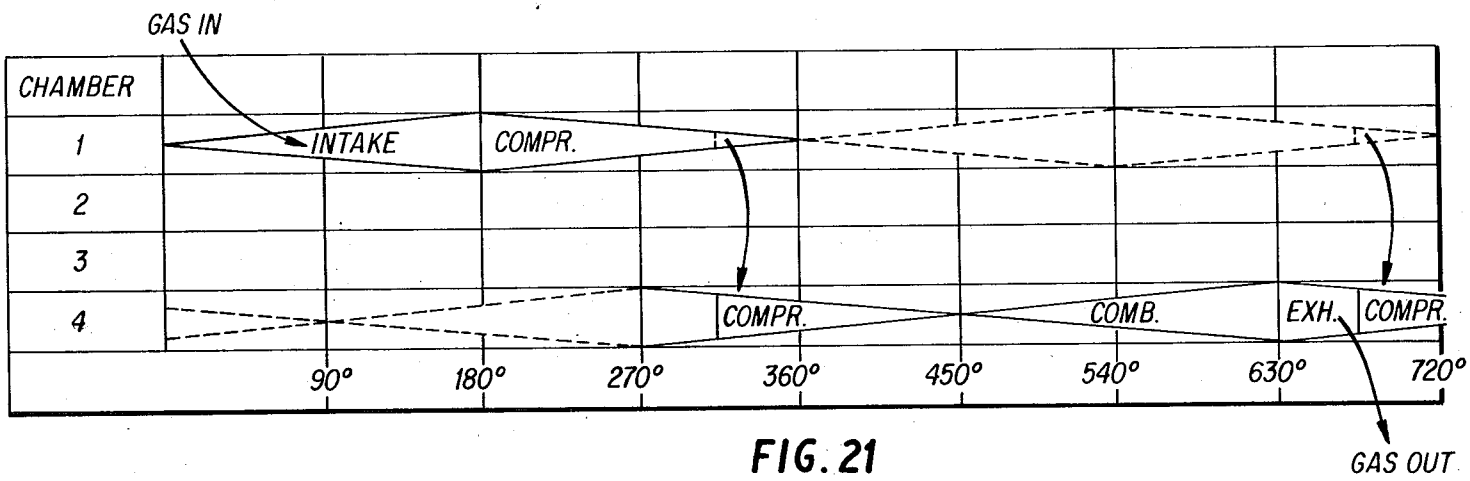
Figure 22:
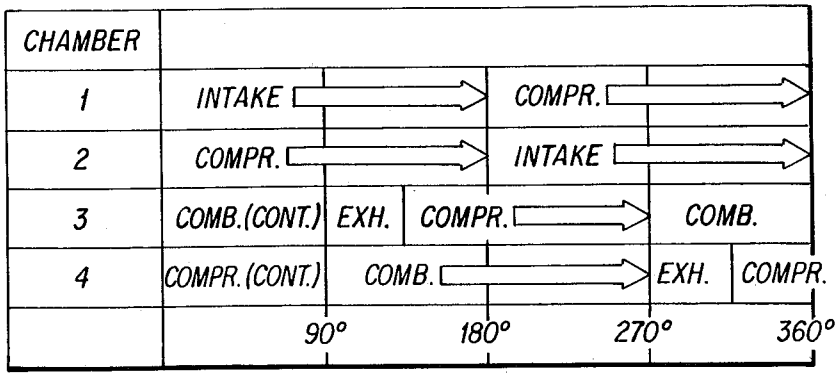
Figure 23:
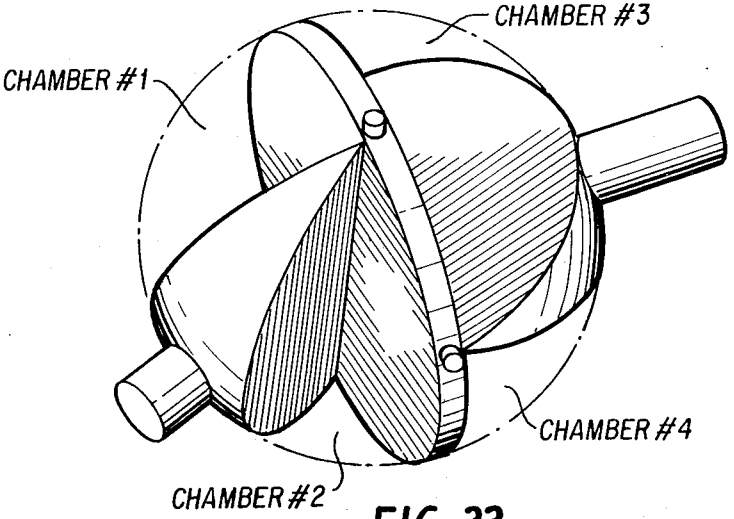

FIG. 21 is a chart of the intake, compression and exhaust cycles of chambers 1 and 4 through 720° and the transfer times of gases therebetween;

FIG. 22 is a chart of the intake, compression and exhaust cycles of chambers 1–4 through 360°; and FIG. 23 is a schematic perspective view illustrating the relative positions of chambers 1–4.

DETAILED DESCRIPTION OF THE INVENTION

Figure 1:
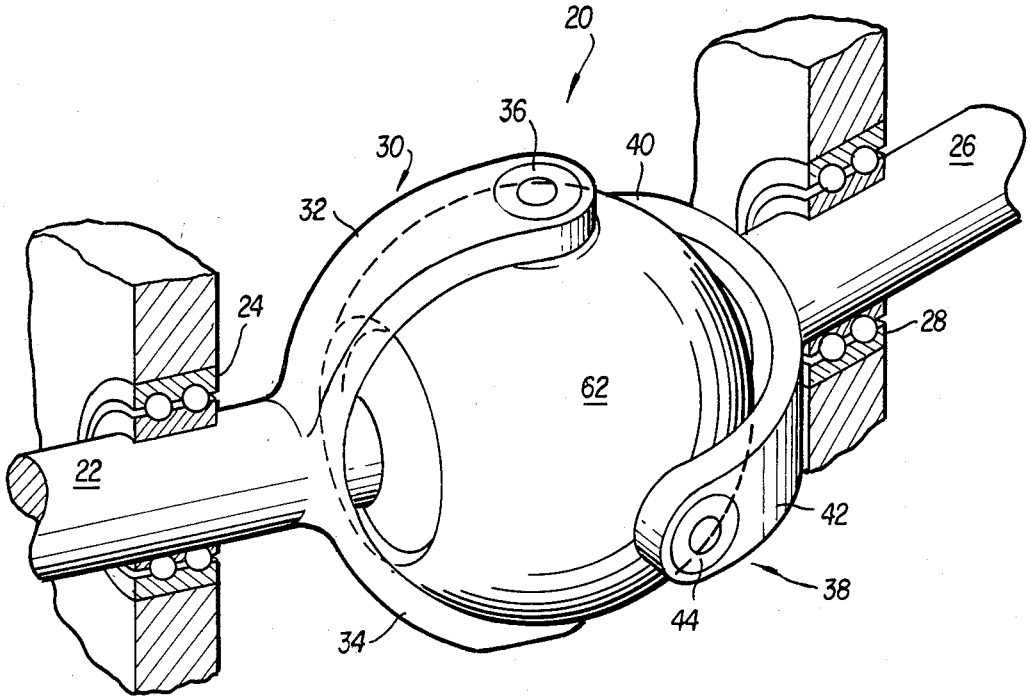
FIG. 1 is a fragmentary perspective view of a rotary engine taken partially in vertical cross section and with portions broken away.

Referring now to FIG. 1 of the drawings, there is illustrated a rotary engine, indicated generally at 20. This rotary engine 20 has a first rotary shaft 22 supported by bearing 24 and a second rotary shaft 26 supported by bearing 28. Shaft members 22 and 26 are disposed at an angle other than 180° relative to each other. This arrangement of components permits the primary active components of the engine to be supported by bearings outside the active chamber.

In order to effect external support of the active elements, a first yoke member, indicated generally at 30, is provided and is attached to rotary shaft 22. Yoke member 30 has a pair of legs 32, 34 each of which is provided with a bearing 36 at its outer extremity. A second yoke member, indicated generally at 38, is carried by rotary shaft 26 with the yoke member being provided with legs 40, 42 each of which carries a bearing 44 at its outer extremity. The yoke members 30, 38 are displaced 90° with respect to each other as illustrated in FIG. 1.

Figure 2:
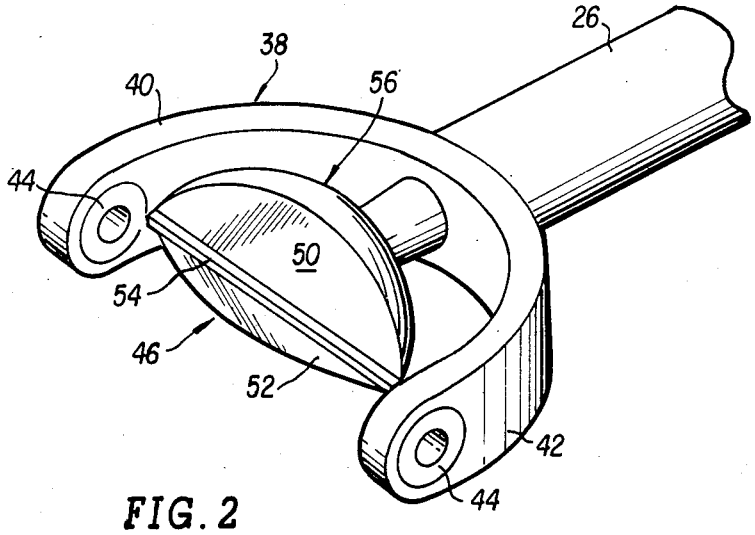
FIG. 2 is a fragmentary perspective view illustrating one of the rotating segments.
Figure 3:
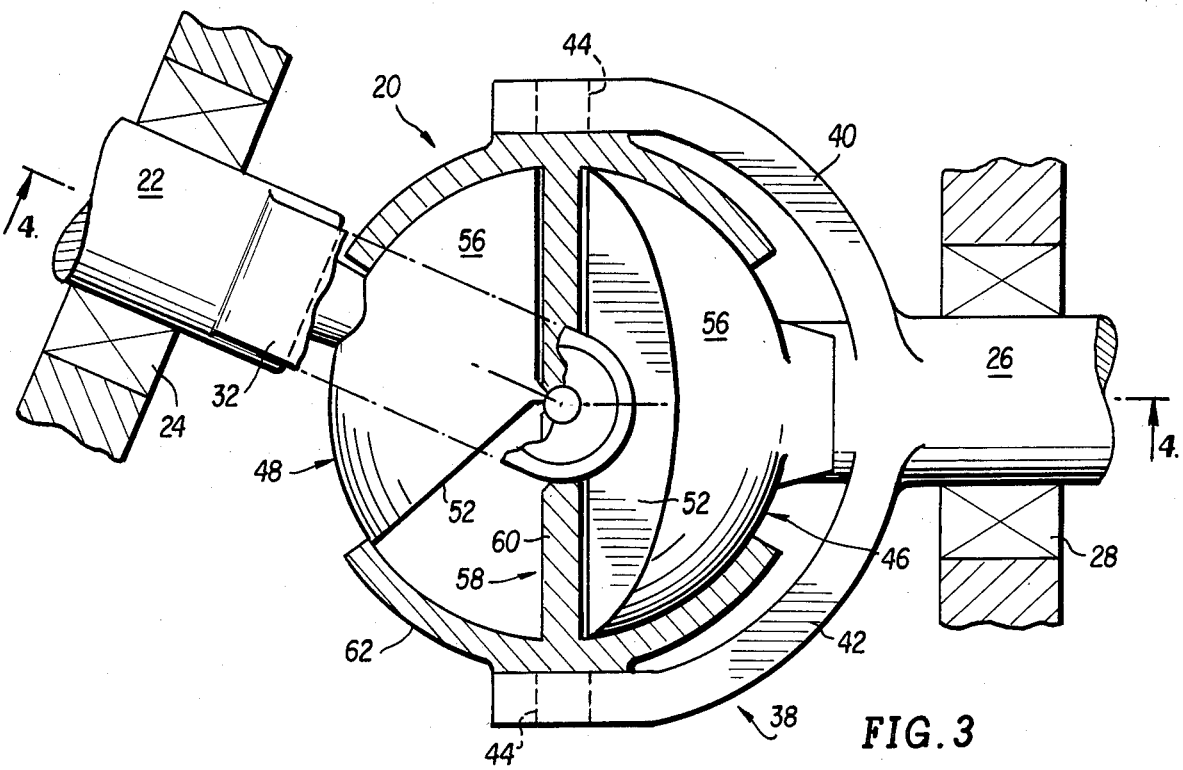
FIG. 3 is a fragmentary top plan view of the rotary engine of FIG. 1 taken partially in horizontal cross section and with portions broken away.
Figure 4:
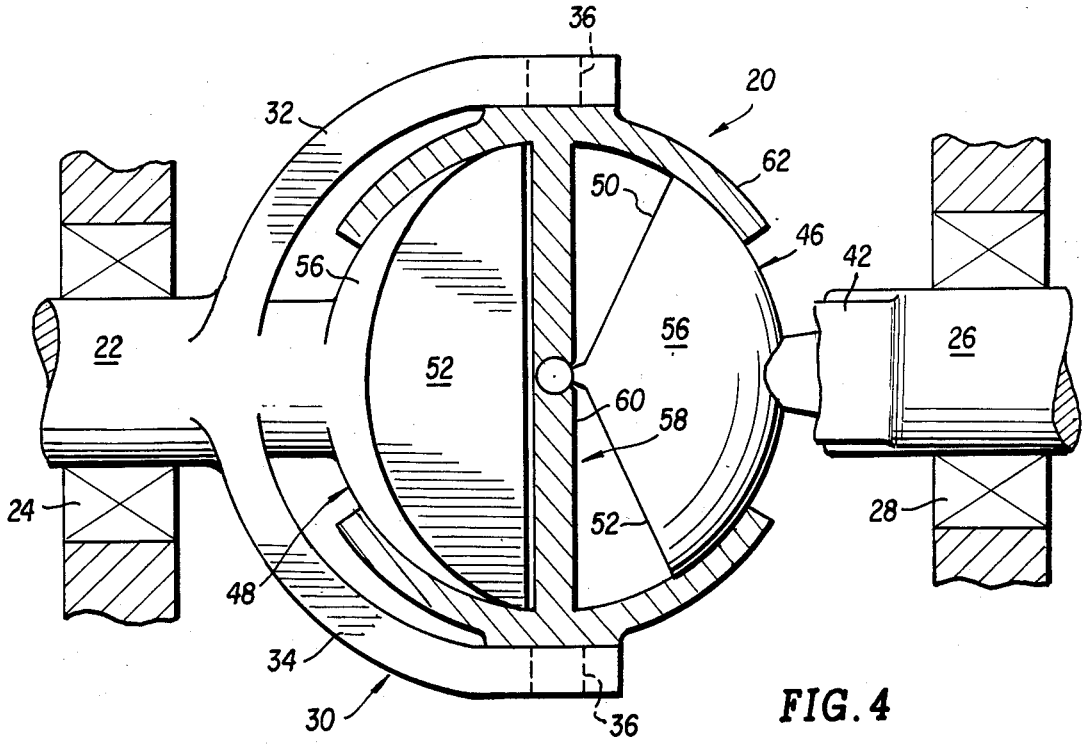
FIG. 4 is a fragmentary elevational view taken partially in vertical cross section along line 4—4 of FIG. 3 and with portions broken away.

Referring now to FIG. 2, numeral 46 generally designates one of a pair of identical rotating spherical segments or pistons. Rotary piston 46 is mounted at an end of rotary shaft 26 and an identical rotating spherical segment or rotary piston 48 is mounted to an adjacent end of rotary shaft 22 and is illustrated in FIGS. 3 and 4. Each rotary piston 46, 48 is provided with a pair of angularly disposed flat surfaces 50, 52 and a central sealing ridge 54. Each rotating spherical segment or rotary piston 46, 48 is also provided with a spherical shell 56. The spherical shell 56 is used to effect a seal as will be explained hereinafter. Spherical shell 56 could also take the form of another curvilinear shape such as a cylindrical shape.

Figure 9:
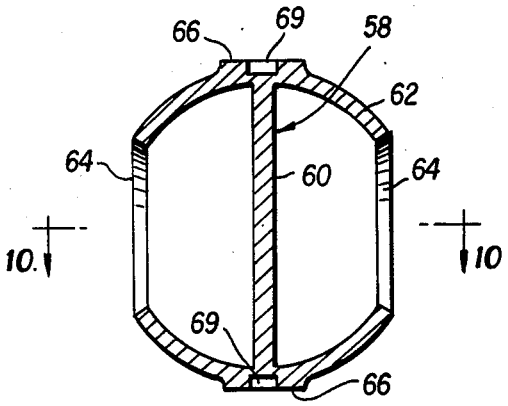
FIG. 9 is an elevational view taken in vertical cross section of the centrally disposed disk member.
Figure 10:
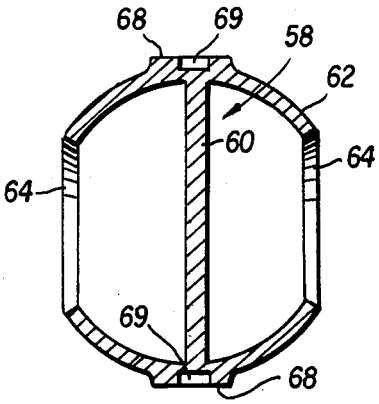
FIG. 10 is a plan view taken in horizontal cross section along line 10—10 of FIG. 9.
Figure 11:
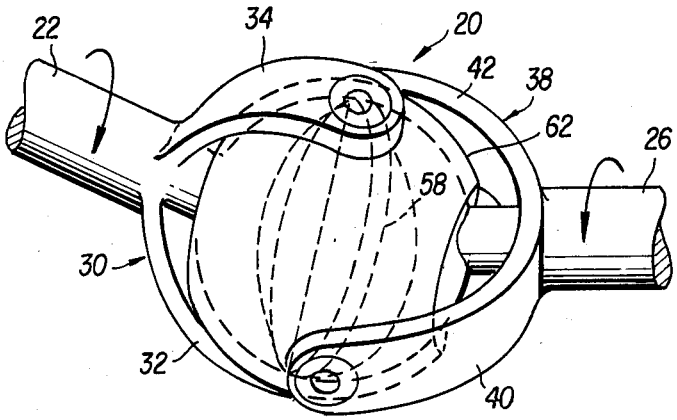
FIG. 11 is a fragmentary front elevational view similar to FIG. 5 after 45° of rotation.
Figure 12:
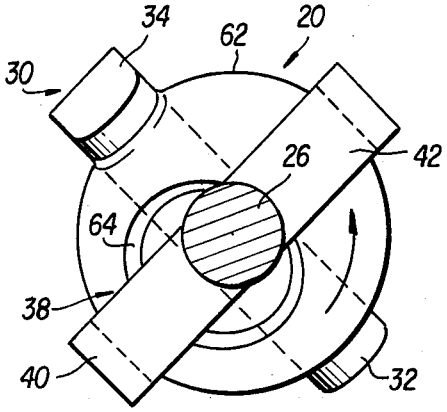
FIG. 12 is a fragmentary end elevational view of the position shown in FIG. 11.

Referring now to FIGS. 9 and 10, there is illustrated by the general designation 58, a centrally disposed disk means. The relationship between the centrally disposed disk means 58 and the identical pair of rotatable spherical segments or rotary pistons 46, 48 is illustrated in FIGS. 3 and 4. The centrally disposed disk means 58 is shown in FIGS. 9 and 10 to comprise a disk member 60 provided with an integral spherical shell 62. This shell 62 forms a spherical chamber except for the diametrically opposed openings at 64 to receive shafts 22, 26. The spherical shell 62 is provided with raised bosses at 66 in FIG. 9 to receive the ends of legs 32, 34 and is also provided with flat bosses 68 in FIG. 10 to receive the ends of legs 40, 42. The spherical chamber 62 is sized so as to form a rotary seal with the complementary spherical shell surfaces 56 on the rotary piston members 46, 48 in the manner illustrated in FIGS. 3 and 4.

Each of the bosses 66, 68 are provided with cylindrical pockets 69 to receive pin members, not shown, which interconnect the spherical shell 62 with the bearings 36, 44 providing a journalling thereof. As can also be seen in FIGS. 3 and 4, the journals provided by the bearings in yoke members 30, 38 lie in a common plane which includes or passes through the disk member 60.

Figure 5:
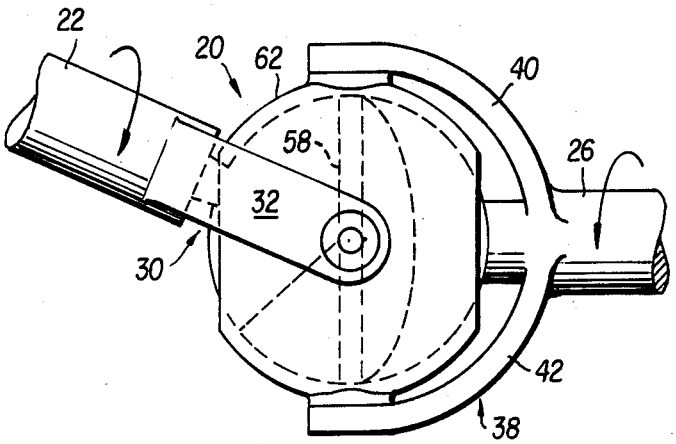
FIG. 5 is a fragmentary front elevational view illustrating a starting position for a rotary engine.
Figure 6:
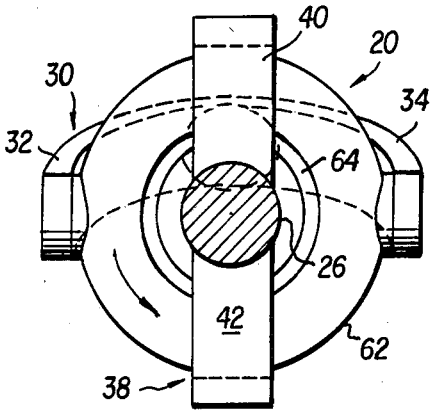
FIG. 6 is a fragmentary end elevational view of the position shown in FIG. 5.

FIGS. 5–8 and 11–14 illustrate a variety of different positions for the rotary engine. FIGS. 5 and 6 illustrate plan and elevational views of a starting position. The movement of the centrally disposed disk means 58 is a combination rotary movement and oscillatory motion. The oscillation of disk means 58 results in an effective reciprocation of disk 60 which effects the expansion and contraction of the volume of the variable volume chambers provided by the rotary engine.

Figure 7:
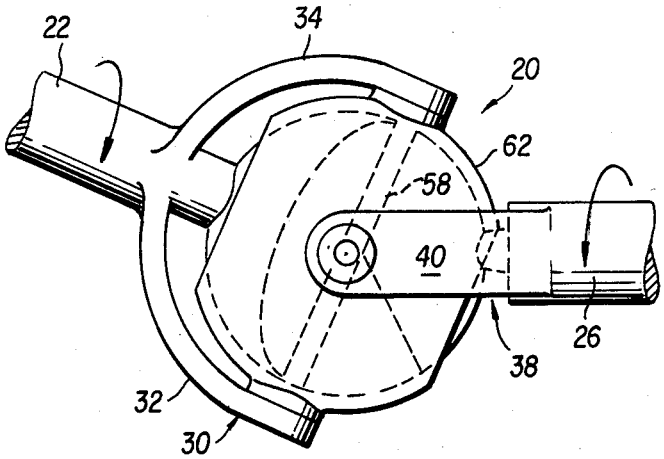
FIG. 7 is a fragmentary front elevational view similar to FIG. 5 but after 90° of rotation.
Figure 8:
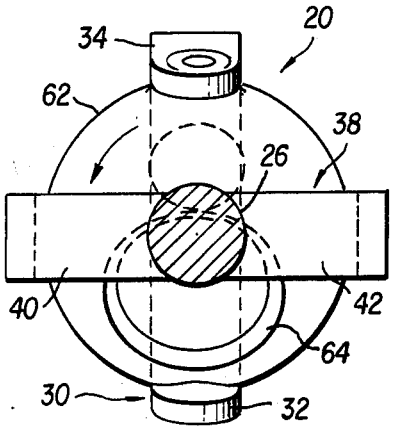
FIG. 8 is a fragmentary end elevational view of the position shown in FIG. 7.
Figure 13:
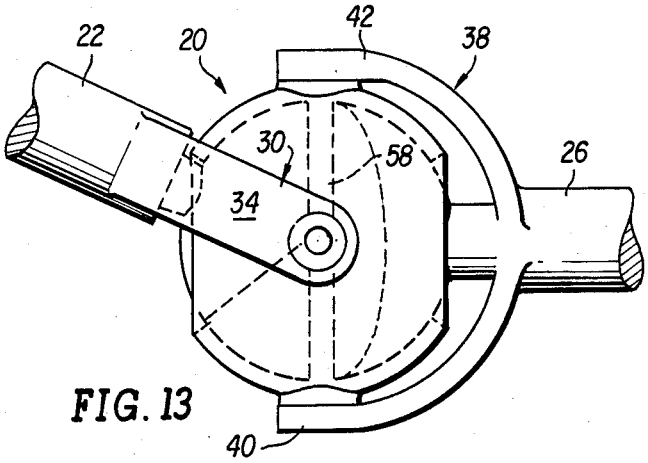
FIG. 13 is a fragmentary front elevational view similar to FIG. 5 but after 180° of rotation.
Figure 14:
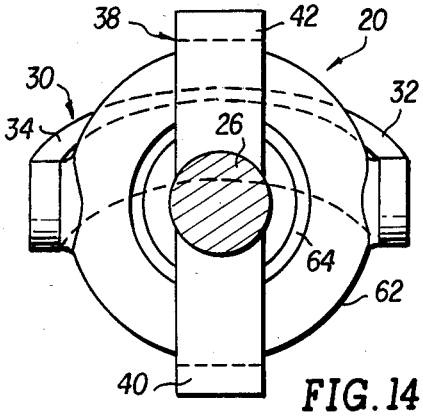
FIG. 14 is a fragmentary end elevational view of the position shown in FIG. 13.

The position illustrated in FIGS. 7 and 8 represents in plan and elevational views, a 90° rotation respectively from the positions shown in FIGS. 5 and 6. The position shown in FIGS. 11 and 12 similarly represents a further 45° rotation from the position in FIGS. 7 and 8 or a rotation of 135° from the respective positions shown in FIGS. 5 and 6. FIGS. 13 and 14 similarly illustrate a 180° rotation from the respective initial positions shown in FIGS. 5 and 6.

Figure 15:
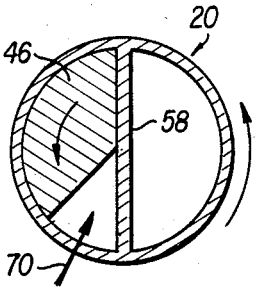
FIGS. 15–18 are schematic views of one chamber only with each successive view schematically rotated 90° from the FIG. 15 position.
Figure 16:
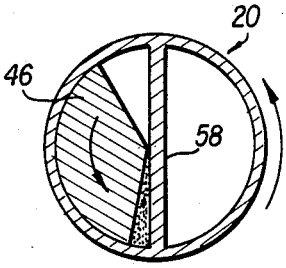
Figure 17:
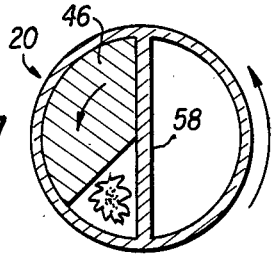
Figure 18:
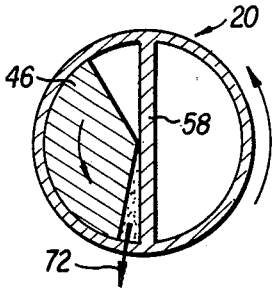

The FIGS. 15–18 illustrate schematically the variations in volumetric capacity for a single chamber with each succeeding view schematically being rotated 180° from the preceding numbered view and showing the intake of fuel in FIG. 15 as designated by arrow 70, the compression of the fuel in FIG. 16, the power stroke for ignition in FIG. 17 and the exhaust of the burned fuel products as designated by the arrow 72 in FIG. 18.

While this is only a schematic designation of the sequence of events, reference is again made to existing prior art patents such as Berry U.S. Pat. No. 3,877,850 for a more complete discussion of the sequence of events.

Figure 19:
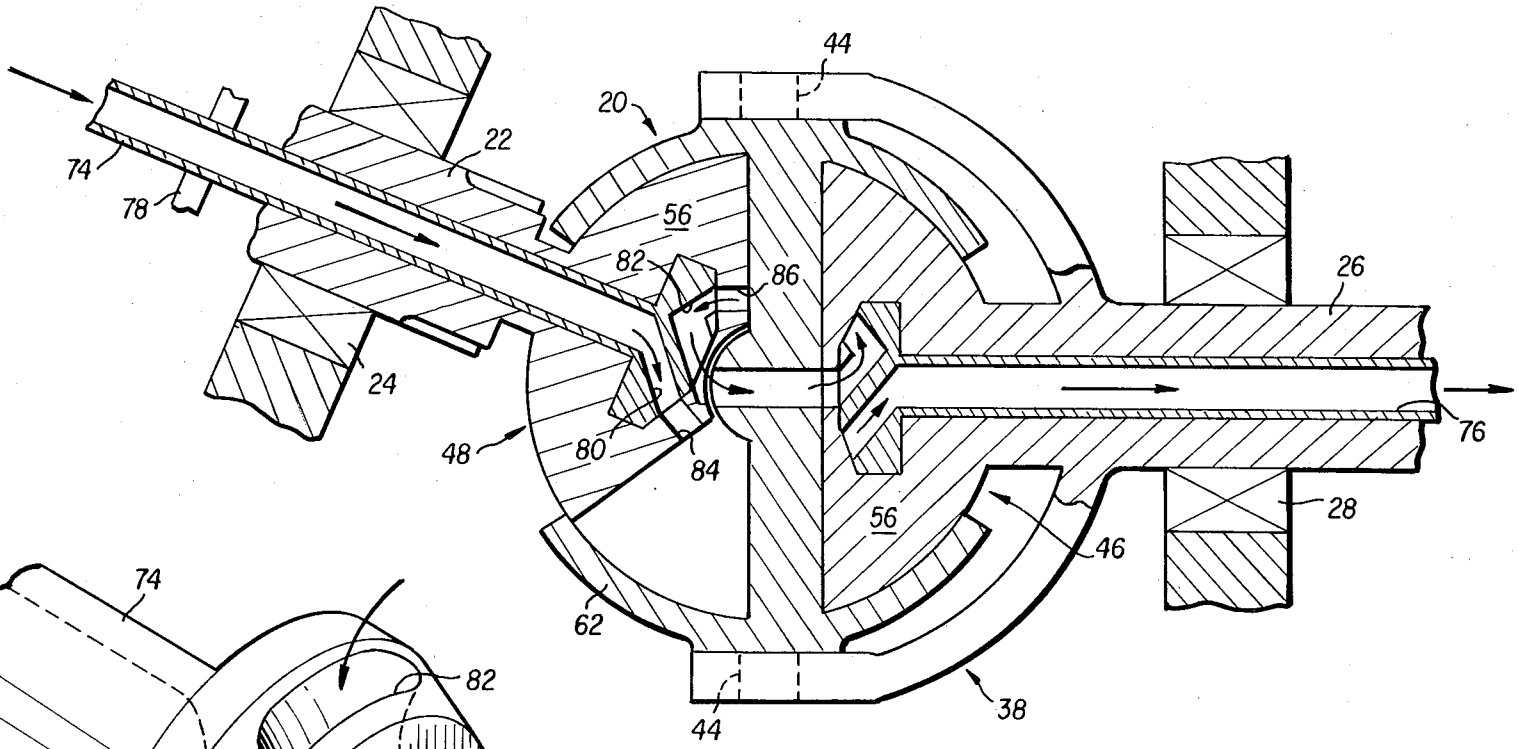
FIG. 19 is a fragmentary top plan view of the rotary engine of FIG. 1 taken in horizontal cross section to illustrate the gas path through the engine.
Figure 20:
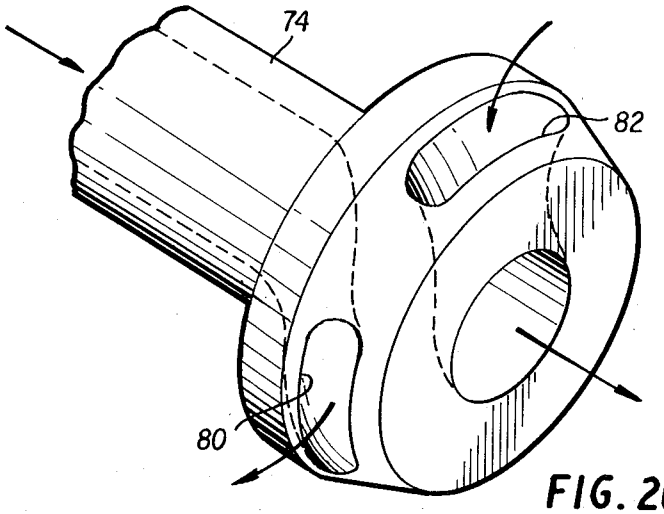
FIG. 20 is an enlarged perspective view of a portion of an intake distributor of FIG. 19.

The important consideration is that by having the bearings located outside the active chambers, it becomes possible to prevent the entire thrust or force loads from being carried by the seals. Thus, the seals have essentially no load being carried on the sealing surfaces except that which is required to effect the seals themselves. This arrangement permits the design of a high precision engine with minute clearances and the use of low coefficient of thermal expansion materials such that no seals are required between the integral spherical shell 62 and the spherical shell 56 of the rotating pistons 46, 48. The valving for the rotary engine is shown in FIGS. 19 and 20 of the drawings wherein it is shown how the unit lends itself to being equipped with valves and ports inside the rotary pistons 46, 48. Conventional valves and cams may rotate with the mechanism or ports may be arranged without active valves for pumps and two cycle engine operations. Alternative piston geometrical configurations can be utilized such as one having a piston outside the yokes.

Various applications may be made utilizing the exterior journalling of the rotating central disk. In the embodiments described thus far, both shafts were rotated with a suitable drive, not shown, being supplied to one of the shafts. In another possible application, neither shaft rotates about its axis but one shaft is swept about the axis of the center of the other shaft such that it moves in a conical pattern with the apex of the cone at the center of the chamber. The value of such an arrangement is that one of the rotary pistons is fixed relative to the mount which facilitates valving and porting.

In another possible application, a straight shaft may be employed in which only one of the set of yokes is attached. The other yoke is attached to a rotating ring outside the chamber. This arrangement is similar to that shown in Appel U.S. Pat. No. 826,983, except that in the patent the ring rotates inside the chamber and the chamber itself does not rotate.

It is also possible to expand the application wherein only one shaft rotates in a conical pattern as described previously by effecting a ganging of units along a shaft and thereby forming a staging effect. The chambers in such an arrangement need not necessarily be of the same size.

The invention is most promising as an internal combustion engine, coupled with a secondary turbine energy recovery system. The ability to use the system with current technology materials such as with those metals and ceramics having a low coefficient of thermal expansion, allows an engine to be built for operations without any cooling system. This achievement will provide extreme improvements in engine efficiency.

Though not part of the inventive concept of the present invention, FIGS. 19–23 are included to illustrate the gas path through the engine. For example, an intake distributor 74 is received within first rotary shaft 22 and an exhaust distributor is received within second rotary shaft 26. Distributors 74 and 76 do not rotate and a support for intake distributor 74 is shown at 78. Each distributor 74, 76 is provided with passageways similar to passageways 80, 82 as is illustrated in FIG. 20 for the intake distributor 74. Passageways 80, 82 are periodically brought into fluid communication with passageways 84, 86 of rotating piston 48.

The intake distributor 74 and exhaust distributor 76 are similar except that the exhaust distributor 76 contains a spark plug or fuel injection nozzle, neither of which are shown, which fires into the chamber.

FIG. 21 illustrates the intake and compression of gas in chamber 1 which is then transferred into chamber 4 for the completion of compression and combustion. The relationship of the four chambers is shown schematically in FIG. 23.

After the combustion cycle, the exhaust port is opened momentarily to exhaust the combustion gases. However, the chamber is only partially closed prior to closing the port such that residual combustion gas in the chamber is mixed with the compressed gas from chamber 1 for the next cycle. This action is depicted at 340 degrees and 690 degrees in the chart of FIG. 21.

The chart presented in FIG. 22 shows the relationship of all four chambers during a single 360 degree rotation of the unit. This chart shows that chambers 2 and 3 interact with each other in a manner similar to that described with respect to chambers 1 and 4 except for the 180 degree phase lag.

While the invention has been illustrated and described with respect to preferred embodiments, it will be recognized that the invention may be otherwise variously embodied and practiced within the scope of the claims which follow.

I claim:

1. A fluid handling device having a plurality of variable volume chambers for use as a pump, compressor or rotary engine which comprises:

a. a first rotary shaft member supported by bearings and carrying variable volume chamber forming components having at least a pair of angularly disposed flat surfaces and a curvilinear shell portion, b. a second rotary shaft member supported by bearings and carrying variable volume chamber forming components having at least a pair of angularly disposed flat surfaces and a curvilinear shell portion, (1) said shaft members being disposed at an angle other than 180° to one another, c. a centrally disposed disk member forming a plurality of variable volume chambers with the flat surfaces of said variable volume chamber forming components, (1) said centrally disposed disk member carrying a curvilinear shell member engageable in sealing relationship with said curvilinear shell portions of each of said variable volume chamber forming components, (2) and said centrally disposed disk member being journalled within bearings carried by a pair of yoke members externally of said curvilinear shell member carried by said disk member and with one of said yoke members being displaced 90° with respect to said other yoke member, (3) one of said yoke members being attached to said first rotary shaft member and the other of said yoke members being attached to said second rotary shaft member.

2. A fluid handling device as defined in claim 1 wherein said curvilinear shell portions of said variable volume chamber forming components and said curvilinear shell of said disk member are each spherical.

3. A fluid handling device as defined in claim 1 wherein the journals provided by the bearings held by said pair of yoke members are in a common plane which passes through said centrally disposed disk member.

* * * * *